US008371057B2

(12) United States Patent
Coffield, III

(10) Patent No.: US 8,371,057 B2
(45) Date of Patent: Feb. 12, 2013

(54) FIREARM CLEANING APPARATUS WITH PROTECTIVE COATING

(75) Inventor: Orus R. Coffield, III, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 1304 days.

(21) Appl. No.: 11/746,551

(22) Filed: May 9, 2007

(65) Prior Publication Data

US 2007/0266610 A1 Nov. 22, 2007

Related U.S. Application Data

(60) Provisional application No. 60/798,874, filed on May 9, 2006.

(51) Int. Cl.
*F41A 29/02* (2006.01)

(52) U.S. Cl. ..... 42/95; 15/104.16

(58) Field of Classification Search .... 42/95; 15/104.16
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,488,647 | A | 4/1924 | Quinn |
| 1,491,604 | A | 4/1924 | Fuller |

(Continued)

FOREIGN PATENT DOCUMENTS

| | | |
|---|---|---|
| DE | 838872 | 5/1952 |
| EP | 0624455 | 11/1994 |

(Continued)

OTHER PUBLICATIONS

U.S. Appl. No. 12/276,223, filed Nov. 21, 2008, Potterfield et al.

(Continued)

*Primary Examiner* — Benjamin P Lee
(74) *Attorney, Agent, or Firm* — Perkins Coie LLP

(57) ABSTRACT

A firearm cleaning apparatus for cleaning the bore of a firearm barrel with firearm cleaning solvent. The apparatus has a cleaning patch holding device for removable attachment to a cleaning rod. The cleaning patch holding device has a body for holding a cleaning cloth containing firearm cleaning solvent. The body has a core material and a protective coating covering the core material to prevent the core material from contacting the cleaning solvent.

5 Claims, 11 Drawing Sheets

U.S. PATENT DOCUMENTS

| | | | | | |
|---|---|---|---|---|---|
| 1,639,722 | A | | 8/1927 | Whitney | |
| 1,693,289 | A | | 11/1928 | Warren | |
| 1,736,244 | A | | 11/1929 | Baker | |
| 1,902,040 | A | | 3/1933 | Meyer | |
| 1,907,181 | A | | 5/1933 | Fey | |
| 1,927,876 | A | | 9/1933 | Meyer | |
| 1,928,871 | A | | 10/1933 | Swebilius | |
| 2,066,218 | A | | 12/1936 | Morgan | |
| 2,079,510 | A | | 5/1937 | King et al. | |
| 2,090,930 | A | | 8/1937 | Chubb | |
| 2,100,514 | A | | 11/1937 | Miller | |
| 2,121,982 | A | | 6/1938 | Pugsley | |
| 2,125,353 | A | | 8/1938 | Mattson | |
| 2,216,766 | A | | 10/1940 | Cook | |
| 2,232,743 | A | | 2/1941 | Swenson | |
| 2,297,993 | A | | 10/1942 | Tratsch | |
| 2,331,372 | A | | 10/1943 | Buchanan | |
| 2,378,545 | A | | 6/1945 | Fraser et al. | |
| D147,305 | S | | 8/1947 | Sloan | |
| 2,432,519 | A | | 12/1947 | Garand | |
| 2,451,266 | A | | 10/1948 | Whittemore | |
| 2,455,644 | A | | 12/1948 | Barnes | |
| 2,476,078 | A | | 7/1949 | Banks | |
| 2,479,354 | A | | 8/1949 | Hanson | |
| 2,483,089 | A | | 9/1949 | Ferguson | |
| 2,484,801 | A | | 10/1949 | Anderson | |
| 2,508,951 | A | | 5/1950 | Kazimier | |
| 2,510,380 | A | | 6/1950 | Clifford | |
| 2,517,268 | A | | 8/1950 | Wilson | |
| 2,638,676 | A | | 5/1953 | Callahan | |
| 2,677,207 | A | | 5/1954 | Stewart | |
| 2,701,930 | A | | 2/1955 | Dolan | |
| 2,731,829 | A | | 1/1956 | Wigington et al. | |
| 2,740,530 | A | | 4/1956 | Ponder | |
| 2,753,642 | A | | 7/1956 | Sullivan | |
| 2,774,090 | A | * | 12/1956 | Allinson | 15/104.165 |
| 2,774,563 | A | | 12/1956 | Pribis | |
| 2,795,881 | A | | 6/1957 | Bellows | |
| 2,813,376 | A | | 11/1957 | Middlemark | |
| 2,817,233 | A | | 12/1957 | Dower et al. | |
| 2,821,117 | A | | 1/1958 | Hultgren | |
| 2,847,909 | A | | 8/1958 | Kester | |
| 2,867,931 | A | | 1/1959 | Schreiber | |
| 2,874,707 | A | | 2/1959 | Koppel | |
| 2,877,689 | A | | 3/1959 | Pribis | |
| 2,894,347 | A | | 7/1959 | Woodcock | |
| 2,924,881 | A | | 2/1960 | Gee | |
| 2,924,904 | A | | 2/1960 | Amsler | |
| 2,924,914 | A | | 2/1960 | Garwood | |
| 2,975,540 | A | | 3/1961 | Lewis | |
| 2,999,788 | A | | 9/1961 | Morgan | |
| 3,011,283 | A | | 12/1961 | Lunn et al. | |
| 3,012,350 | A | | 12/1961 | Wold | |
| 3,013,289 | A | * | 12/1961 | Sasena | 15/181 |
| 3,023,527 | A | | 3/1962 | Leek et al. | |
| 3,024,653 | A | | 3/1962 | Broadway | |
| 3,041,938 | A | | 7/1962 | Seabrook | |
| 3,055,655 | A | | 9/1962 | Chelf | |
| 3,060,612 | A | | 10/1962 | Brown et al. | |
| 3,107,642 | A | | 10/1963 | Lakin | |
| 3,112,567 | A | | 12/1963 | Flanagan | |
| 3,125,929 | A | | 3/1964 | Peasley | |
| 3,128,668 | A | | 4/1964 | Dicken | |
| 3,137,957 | A | * | 6/1964 | Ingalls | 42/70.11 |
| 3,163,420 | A | | 12/1964 | Braun | |
| 3,175,456 | A | | 3/1965 | Goodsell | |
| 3,183,617 | A | | 5/1965 | Ruger et al. | |
| 3,205,518 | A | * | 9/1965 | Romaine | 15/104.165 |
| 3,206,885 | A | | 9/1965 | Dye | |
| 3,225,656 | A | | 12/1965 | Flaherty et al. | |
| D203,680 | S | | 2/1966 | Allison | |
| 3,240,103 | A | | 3/1966 | Lamont | |
| 3,259,986 | A | | 7/1966 | Carr | |
| 3,283,425 | A | | 11/1966 | Boyd | |
| 3,283,643 | A | | 11/1966 | Mittelsteadt | |
| 3,291,317 | A | | 12/1966 | Bowen | |
| 3,292,293 | A | | 12/1966 | Chiasera et al. | |
| 3,320,848 | A | | 5/1967 | Ponsness | |
| 3,323,246 | A | | 6/1967 | Loffler | |
| 3,327,422 | A | | 6/1967 | Harris | |
| 3,330,561 | A | | 7/1967 | Kandel | |
| 3,343,411 | A | | 9/1967 | Lee | |
| 3,353,827 | A | | 11/1967 | Dun, Jr. | |
| 3,370,852 | A | | 2/1968 | Kandel | |
| 3,406,969 | A | | 10/1968 | Tisdell et al. | |
| 3,423,092 | A | | 1/1969 | Kandel | |
| D215,311 | S | | 9/1969 | Born | |
| 3,486,752 | A | | 12/1969 | Colvin | |
| 3,499,525 | A | | 3/1970 | Kanter | |
| 3,510,951 | A | | 5/1970 | Dow | |
| 3,513,604 | A | | 5/1970 | Matsunaga et al. | |
| 3,536,160 | A | * | 10/1970 | Brewer | 184/109 |
| 3,550,941 | A | | 12/1970 | Spiro et al. | |
| 3,556,666 | A | | 1/1971 | Lichenstern | |
| D220,154 | S | | 3/1971 | Irelan | |
| 3,572,712 | A | | 3/1971 | Vick | |
| 3,580,127 | A | | 5/1971 | Lee | |
| 3,583,556 | A | | 6/1971 | Wagner | |
| 3,584,820 | A | | 6/1971 | Butcher, Sr. | |
| 3,587,193 | A | | 6/1971 | Lewis | |
| 3,608,225 | A | | 9/1971 | Manuel | |
| 3,646,704 | A | | 3/1972 | Ellsworth | |
| 3,680,266 | A | | 8/1972 | Shiplov | |
| 3,680,354 | A | | 8/1972 | Phillips, Jr. | |
| 3,711,955 | A | | 1/1973 | Holt | |
| 3,711,984 | A | | 1/1973 | Dyer et al. | |
| 3,736,243 | A | * | 5/1973 | Duggan | 204/196.26 |
| 3,738,101 | A | * | 6/1973 | Simon-Vermot | 368/125 |
| 3,739,515 | A | | 6/1973 | Koon, Jr. | |
| 3,743,088 | A | | 7/1973 | Henkin | |
| 3,744,292 | A | | 7/1973 | Michelson | |
| 3,745,875 | A | | 7/1973 | Kennedy et al. | |
| 3,748,950 | A | | 7/1973 | Huntington | |
| 3,764,219 | A | | 10/1973 | Collins | |
| 3,769,758 | A | | 11/1973 | McDonald | |
| 3,771,176 | A | | 11/1973 | Herman, Sr. | |
| 3,804,238 | A | | 4/1974 | Howard | |
| 3,813,816 | A | | 6/1974 | Funk | |
| 3,815,270 | A | | 6/1974 | Pachmayr | |
| 3,826,559 | A | | 7/1974 | Berliner et al. | |
| 3,827,172 | A | | 8/1974 | Howe | |
| 3,842,527 | A | | 10/1974 | Low | |
| D233,853 | S | | 12/1974 | Ferrara | |
| 3,877,178 | A | | 4/1975 | Campanelli | |
| 3,878,939 | A | | 4/1975 | Wilcox | |
| 3,885,357 | A | | 5/1975 | Hoyt | |
| 3,893,266 | A | | 7/1975 | Anderson et al. | |
| 3,895,803 | A | | 7/1975 | Loe | |
| 3,899,175 | A | | 8/1975 | Loe | |
| 3,899,797 | A | | 8/1975 | Gunst | |
| D237,106 | S | | 10/1975 | Baljet et al. | |
| 3,913,746 | A | | 10/1975 | Burton | |
| 3,914,879 | A | | 10/1975 | Taylor, III et al. | |
| 3,935,657 | A | | 2/1976 | Wade | |
| 3,947,988 | A | | 4/1976 | Besaw | |
| 3,949,987 | A | | 4/1976 | Candor | |
| 3,961,436 | A | | 6/1976 | Hagen et al. | |
| 3,964,613 | A | | 6/1976 | Anderson, Jr. | |
| 3,979,849 | A | | 9/1976 | Haskins | |
| 4,007,554 | A | | 2/1977 | Helmstadter | |
| 4,012,860 | A | | 3/1977 | Auger | |
| 4,021,971 | A | | 5/1977 | McFadden | |
| 4,026,057 | A | | 5/1977 | Cady | |
| 4,027,781 | A | | 6/1977 | Covert | |
| 4,042,242 | A | | 8/1977 | Nicholls et al. | |
| 4,054,288 | A | | 10/1977 | Perrine, Sr. | |
| 4,055,016 | A | | 10/1977 | Katsenes | |
| 4,072,313 | A | | 2/1978 | Murso et al. | |
| 4,076,247 | A | | 2/1978 | Kim et al. | |
| 4,090,606 | A | | 5/1978 | Dawson | |
| 4,120,108 | A | | 10/1978 | Vickers et al. | |
| 4,120,276 | A | | 10/1978 | Curran | |
| 4,122,623 | A | | 10/1978 | Stice | |
| 4,143,491 | A | | 3/1979 | Blanc | |
| 4,177,608 | A | | 12/1979 | Balz | |
| 4,188,855 | A | | 2/1980 | Alberts | |
| 4,203,600 | A | | 5/1980 | Brown | |

4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,499 A 12/1987 Franklin
4,716,673 A * 1/1988 Williams et al. ..... 42/95
4,721,205 A 1/1988 Burt et al.
4,723,472 A 2/1988 Lee
4,729,186 A 3/1988 Rieger et al.
4,736,843 A 4/1988 Leonard
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A * 1/1990 French ..... 42/90
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A * 8/1994 Brown et al. ..... 42/95
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson 5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
5,446,987 A * 9/1995 Lee et al. ..... 42/61
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A * 12/1996 Hughes ..... 42/95
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,651,207 A * 7/1997 Knight ..... 42/95
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,207,567 B1 4/2007 Brown
7,213,494 B2 5/2007 James
7,225,050 B2 5/2007 Sutula, Jr.
D553,219 S 10/2007 Potterfield
7,281,346 B1 10/2007 Cook et al.
D567,895 S 4/2008 Cauley
7,356,960 B1 4/2008 Knitt
7,356,961 B2 * 4/2008 Williams ..... 42/95
7,357,250 B2 4/2008 Hagemann et al.
7,363,740 B2 4/2008 Kincel
7,367,451 B2 5/2008 Pendergraph et al.
7,401,431 B2 7/2008 Pierce et al.
7,410,053 B2 8/2008 Bowen et al.
D576,245 S 9/2008 Potterfield et al.
7,421,815 B1 9/2008 Moody et al.
7,426,800 B2 9/2008 Pierce et al.
7,536,820 B2 5/2009 Wade et al.
7,549,247 B1 6/2009 Reese
7,584,690 B2 9/2009 Cauley
D605,246 S 12/2009 Hobbs
7,631,455 B2 12/2009 Keng et al.
7,637,451 B2 12/2009 Gentner et al.

| | | | | |
|---|---|---|---|---|
| 7,654,498 | B1 | 2/2010 | Beltz | |
| 7,676,977 | B1 | 3/2010 | Cahill et al. | |
| 7,726,478 | B2 | 6/2010 | Potterfield et al. | |
| 7,730,824 | B1 | 6/2010 | Black | |
| 2002/0113372 | A1 | 8/2002 | Love | |
| 2002/0195752 | A1* | 12/2002 | Yang | 264/671 |
| 2003/0079395 | A1 | 5/2003 | Chong | |
| 2004/0020097 | A1 | 2/2004 | Deros | |
| 2004/0112777 | A1 | 6/2004 | Huang | |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1 | 6/2005 | Minneman | |
| 2005/0178039 | A1* | 8/2005 | Flores | 42/95 |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0163534 | A1 | 7/2006 | Sugimoto et al. | |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0236584 | A1* | 10/2006 | Williams | 42/95 |
| 2006/0248774 | A1 | 11/2006 | Pierce et al. | |
| 2006/0248775 | A1 | 11/2006 | Wade et al. | |
| 2006/0254111 | A1 | 11/2006 | Giauque et al. | |
| 2006/0277811 | A1* | 12/2006 | Peterson | 42/95 |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0051028 | A1* | 3/2007 | Stordal | 42/95 |
| 2007/0068379 | A1 | 3/2007 | Sween et al. | |
| 2007/0074439 | A2 | 4/2007 | Cauley et al. | |
| 2007/0074440 | A2 | 4/2007 | Cauley | |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0294929 | A1 | 12/2007 | Potterfield et al. | |
| 2007/0294930 | A1* | 12/2007 | Mays | 42/95 |
| 2007/0295197 | A1 | 12/2007 | Potterfield | |
| 2008/0023379 | A1 | 1/2008 | Potterfield et al. | |
| 2008/0023915 | A1 | 1/2008 | Morrow et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0128002 | A1 | 6/2008 | Jeffs | |
| 2008/0156671 | A1 | 7/2008 | Jansson | |
| 2008/0168697 | A1 | 7/2008 | Potterfield et al. | |
| 2008/0174071 | A1 | 7/2008 | Potterfield et al. | |
| 2008/0196745 | A1 | 8/2008 | Conrad | |
| 2009/0049731 | A1 | 2/2009 | Seuk | |
| 2009/0056192 | A1 | 3/2009 | Oz | |
| 2009/0126250 | A1 | 5/2009 | Keng | |
| 2010/0116163 | A1 | 5/2010 | Zara | |

FOREIGN PATENT DOCUMENTS

| | | | |
|---|---|---|---|
| EP | 0811466 | A2 | 12/1997 |
| GB | 475080 | | 11/1937 |

OTHER PUBLICATIONS

U.S. Appl. No. 12/276,229, filed Nov. 21, 2008, Cauley et al.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 28 pages.
Final Office Action; U.S. Appl. No. 11/339,863; Mailed on Mar. 10, 2009, 22 pages.
Final Office Action; U.S. Appl. No. 11/505,784; Mailed on Dec. 19, 2008, 10 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.
Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
U.S. Appl. No. 12/476,041, filed Jun. 1, 2009, Cauley.
U.S. Appl. No. 12/578,393, filed Oct. 13, 2009, Morrow et al.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/801,341; Mailed on Sep. 30, 2009, 6 pages.
Final Office Action; U.S. Appl. No. 11/853,763; Mailed on Jul. 13, 2009, 7 pages.
Non-Final Office Action; U.S. Appl. No. 11/206,430; Mailed on Jun. 23, 2009, 13 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/853,745; Mailed on Jun. 19, 2009, 11 pages.
Non-Final Office Action; U.S. Appl. No. 12/117,668; Mailed on Aug. 13, 2009, 15 pages.
Non-Final Office Action; U.S. Appl. No. 12/209,113; Mailed on Sep. 23, 2009, 6 pages.
Non-Final Office Action; U.S. Appl. No. 11/505,784; Mailed on Oct. 27, 2009, 8 pages.
U.S. Appl. No. 11/431,956, filed May 10, 2006, Morrow et al.
U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo Wii, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-

Fully-Adj..., 3 pgs, the date on which The Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4 &subcat=22, pp. 1-4 [Internet accessed Jan. 16, 2006].
Birchwood Casey, "Shoot•N•C® Targets," http://www.birchwoodcasey.com/sport/target_index.asp?categoryID=4 &subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4 &subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005, 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, Instra-View™ Targets, 1 page.
Californiavarmintcallers.com—Forum, http://californiavarmintcallers.com/community/modules/newbb/viewtopic.php?topic_id=10 &forum=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2.
Caldwells Insta-View 4" Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol," The Cartridge Components, SPEER Omark Industries, pp. 28-54.
"Shotshell reloading with a GRABBER 76," MEC—Mayville Engineering Company, Inc., pp. 1-12.
Sweeney, P "Gunsmithing: Measure Headspace," Peterson's Rifleshooter, http://www.rifleshootermag.com/gunsmithing/headspace_0612/, 4 pages [Internet Accessed Dec. 11, 2004].
Tenex Precision Co., "Recoil A-Rest-R," 4 pages [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooter's Ridge, a division of ATK, and available at least by late 2005, 1 page.
"Uncle Bud'S Udder Bag," http:www.unclebudscss.com/pages/Udder%20Bags.html, 2 pgs. [Internet accessed on Feb. 14, 2006].
"Uncle Bud'S Bull Bags," http:www.unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id=..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].

Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product__10151__-1__10001__95064__SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup__2htm, 6 pages [Internet accessed on Aug. 31, 2007].

Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-_7gnY4CFRVNhgodjFhfSQ, 29 pages [Internet accessed on Aug. 30, 2007].
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 7, 2006, 8 pages.
Final Office Action; U.S. Appl. No. 10/865,595; Mailed on Apr. 3, 2007, 10 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
International Search Report and Written Opinion; International Patent Application No. PCT/US07/76440; Filed: Aug. 21, 2007; Applicant: Battenfeld Technologies, Inc.; Mailed on Sep. 30, 2008.
Non-Final Office Action; U.S. Appl. No. 11/339,863; Mailed on Sep. 23, 2008, 7 pages.
Final Office Action; U.S. Appl. No. 11/271,100; Mailed on Sep. 22, 2008, 8 pages.
Non-Final Office Action; U.S. Appl. No. 11/507,683; Mailed on Sep. 18, 2008, 8 pages.
Non-Final Office Action; U.S. Appl. No. 11/679,100; Mailed on Oct. 16, 2008, 11 pages.
U.S. Appl. No. 12/209,113, filed Sep. 11, 2008, Potterfield et al.
European Search Report; European Patent Application No. 07863915.0; Filed: Nov. 5, 2007; Applicant: Battenfeld Technologies, Inc.; Mailed on Oct. 14, 2010.
Non-Final Office Action; U.S. Appl. No. 12/172,848, Mailed on Nov. 22, 2010, 32 pages.
Non-Final Office Action; U.S. Appl. No. 11/206,430; Mailed on Oct. 14, 2010, 18 pages.
U.S. Appl. No. 12/614,578, filed Nov. 9, 2009, Zara.
U.S. Appl. No. 12/623,238, filed Nov. 20, 2009, Potterfield.
Final Office Action; U.S. Appl. No. 11/607,550; Mailed on Nov. 27, 2009, 14 pages.
Non-Final Office Action; U.S. Appl. No. 11/740,908; Mailed on Jan. 29, 2010, 8 pages.
Non-Final Office Action; U.S. Appl. No. 12/177,032; Mailed on Feb. 23, 2010, 6 pages.
Non-Final Office Action; U.S. Appl. No. 12/476,041; Mailed on Nov. 18, 2009, 6 pages.
Final Office Action; U.S. Appl. No. 11/206,430; Mailed on Apr. 1, 2010, 14 pages.
Final Office Action; U.S. Appl. No. 11/431,956; Mailed on Nov. 27, 2009, 13 pages.
Final Office Action; U.S. Appl. No. 11/507,683; Mailed on Apr. 6, 2010, 7 pages.
U.S. Appl. No. 12/769,438, filed Apr. 28, 2010, Potterfield.
U.S. Appl. No. 12/846,543, filed Jul. 29, 2010, Potterfield.
Final Office Action; U.S. Appl. No. 11/679,832; Mailed on Jun. 8, 2010, 12 pages.
Final Office Action; U.S. Appl. No. 11/844,980; Mailed on May 25, 2010, 6 pages.
Final Office Action; U.S. Appl. No. 12/476,041; Mailed on Jul. 20, 2010, 7 pages.
Final Office Action; U.S. Appl. No. 12/177,032; Mailed on Oct. 5, 2010, 11 pages.
Non-Final Office Action; U.S. Appl. No. 11/607,550; Mailed on Jun. 17, 2010, 12 pages.
Non-Final Office Action; U.S. Appl. No. 11/679,100; Mailed on May 28, 2010, 9 pages.
Non-Final Office Action; U.S. Appl. No. 12/276,229; Mailed on Aug. 30, 2010, 8 pages.

* cited by examiner

FIREARM CLEANING APPARATUS WITH PROTECTIVE COATING

CROSS-REFERENCE TO RELATED APPLICATION

The present application claims priority to U.S. Provisional Patent Application No. 60/798,874, filed May 9, 2006, the disclosure of which is incorporated herein by reference in its entirety.

TECHNICAL FIELD

The present application relates generally to firearm cleaning devices and methods, and more specifically, to firearm cleaning devices with protective coating thereon.

BACKGROUND

This invention relates generally to a firearm cleaning apparatus for cleaning the bore of a firearm barrel, and more particularly to a cleaning patch holding device having a body with a protective coating to prevent a core material of the body from reacting with cleaning solvents.

When a rifle, handgun or shotgun is fired, the bullet or projectile is forced through the barrel at an extremely high speed by gas formed by the burning powder in the cartridge case. This gas generates great pressure on the base of the projectile and forces the projectile through the barrel. The high pressure is necessary as the projectile in most cases is made of a relatively soft metal such as lead or copper alloy and is a slightly larger diameter than the internal diameter of the barrel bore. The larger diameter of the projectile ensures that the projectile will completely fill the bore and will prevent any gas escaping around the projectile while it is inside the barrel. The prevention of gas from escaping around the projectile ensures the maximum utilization of the energy of the expanding gas that forces the projectile from the barrel.

As the projectile moves through the barrel bore, friction is generated by contact and abrasion between the side of the projectile or bullet and the surface of the bore. A consequence of this friction is the erosion of small amounts of copper or lead from the bullet as it passes through the barrel. The metal removed from the bullet, or fouling, is deposited on the surface of the bore. With repeated firing this fouling can build up to such a degree as to dramatically affect the passage of subsequently fired bullets. The build-up of fouling in the bore increases friction between the bullet and bore, eventually resulting in a gradual degradation in accuracy of the firearm.

Shooters employ a number of techniques to clean fouling from the bore. The most popular, and effective, cleaning technique utilizes a patch of cleaning cloth material soaked with a cleaning solvent that dissolves the fouling deposited on the interior surface of the barrel. The solvent-soaked cleaning cloth is normally placed in a special fitting, or holder, attached to a metal cleaning rod and pushed through the barrel bore. Two distinct types of holders known in the art for securing the cleaning cloth to the cleaning rod include jags and patch loops. A jag is cylindrically shaped and slightly smaller than the diameter of the bore. It features a sharp point on which the patch is impaled to secure it during cleaning. A patch loop is shaped similar to the eye of a sewing needle. The patch loop has a cylindrical shank with an elliptically shaped opening on the end. The patch of cleaning cloth is inserted through the elliptical opening up to its midpoint to secure it during cleaning. Both types of holders are typically made of brass because brass has the advantage of being softer than the steel of the firearm barrel and is less likely to scratch or damage the barrel bore.

As the solvent-soaked cleaning cloth is pushed through the bore, fouling on the bore that reacts with the cleaning solvent dissolves and is absorbed in the cloth. The dissolved fouling absorbed by the cloth gives the cloth a distinctive color. Typically, residue from bullet fouling is blue, green, or a combination thereof. The distinctive color allows the user to monitor the cleaning of the barrel bore by removing the cleaning cloth and checking for additional accumulation of dissolved fouling on the cloth. The more residue on the cleaning cloth, the greater the amount of fouling that is assumed to have been removed, or dissolved by the cleaning solvent. As a cleaning cloth becomes saturated with fouling residue it is replaced with a clean cloth. When subsequent patches of cleaning cloth show no further residue from the dissolved bullet fouling, the barrel is considered to be clean.

Solvents intended to dissolve copper bullet fouling will also react with brass jags and patch loops, because a main component of brass is copper. This results in patches of cleaning cloth having blue-green residue from the solvent reaction with the jag or patch loop material. Residue on the cleaning cloth from the brass jag or patch loop frequently causes the user to incorrectly believe copper fouling is still present in the bore and to continue cleaning the bore after all the fouling has been removed.

Attempts have been made to construct jags and patch loops that are not reactive with bore solvents by utilizing materials other than brass for jags and patch loops. Generally these attempts have not been successful. Plastic cleaning cloth holders tend to be weak and will break or bend during use. Steel holders, while harder than traditional brass holders, can easily scratch or damage the bore of the barrel. Aluminum holders tend to oxidize rapidly, allow the embedding of grit or abrasive material, and are easily bent or deformed.

Accordingly, there is a need for a cleaning patch holding device that resists chemical reaction with the cleaning solvent and allows the utilization of materials strong enough to properly perform the firearm cleaning function.

SUMMARY

This invention provides the user with a cleaning patch holding device that will not be substantially adversely affected by the chemical solvents normally found in commercially available bore cleaners. Consequently, there will be no trace of dissolved metal from the cleaning patch holding device on the cleaning patches during the cleaning process. Accordingly, any visible trace of dissolved metal on the cleaning patch is only attributable to the fouling build-up deposited on the interior surface of the barrel and not from the cleaning patch holding device.

In one embodiment, the cleaning patch holding device has a coating covering the exterior surface of the patch holding device. The coating permits the use of brass or any other suitable material having appropriate strength and rigidity as the base material of the holding device. The coating of the patch holding device may be of any number of different materials. It may be, but is not limited to, a plastic or synthetic coating, a chemical, electrolytic, or electroless metal plated coating, or a paint or other suitable coating. The inert, non-reactive coating on the patch holding device ensures that any commonly used chemical bore solvent will dissolve only the bullet residue in the firearm bore rather than the material of the patch holding device.

BRIEF DESCRIPTION OF THE DRAWINGS

Corresponding parts are designated by corresponding reference numbers throughout the drawings.

DETAILED DESCRIPTION

Figure 1:
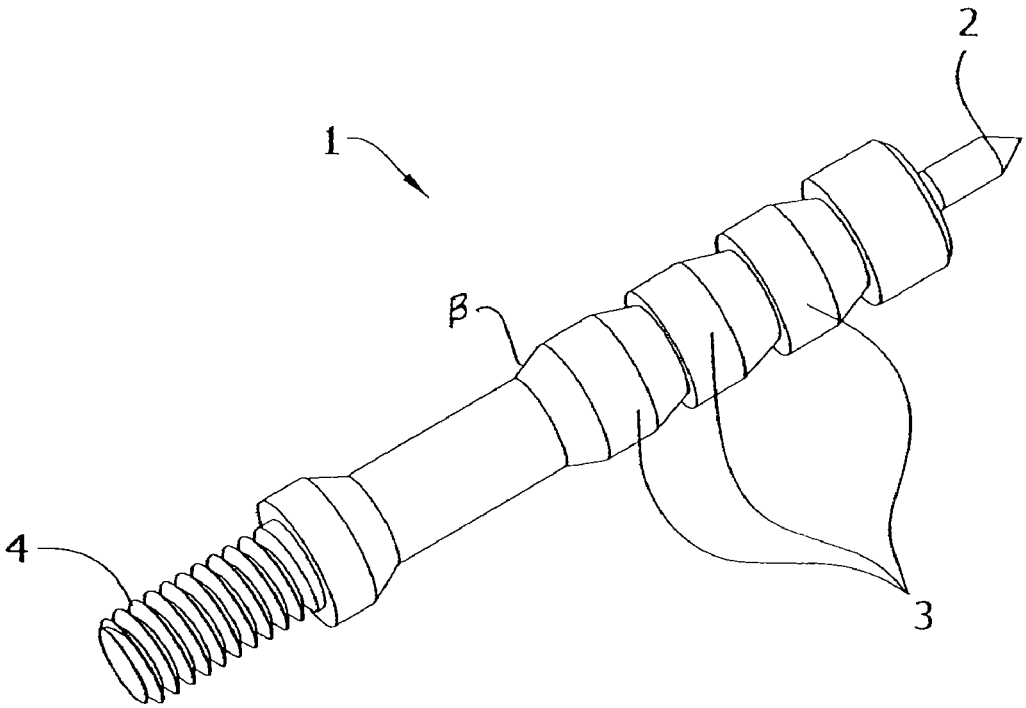
FIG. 1 is a perspective view of a prior art patch holding device in the form of a jag.

Two distinct types of cleaning patch holding devices for cleaning a barrel 25 (FIG. 9) of a firearm R are known in the art. One such holding device, commonly known as a jag 1, is shown in FIG. 1. The jag 1 has a generally cylindrical body B with a sharp point 2 at the leading end that is used to secure a patch 18 (FIG. 4) of cleaning cloth containing cleaning solvent for the removal of fouling build-up from the inside surface of the firearm barrel. Annular grooves 3 formed in the body B help provide a tight fit between the cleaning patch 18 and the interior surface of the barrel. Threads 4 formed on the rear end of the body B allow for releasable attachment to a cleaning rod (FIG. 3).

Figure 2:
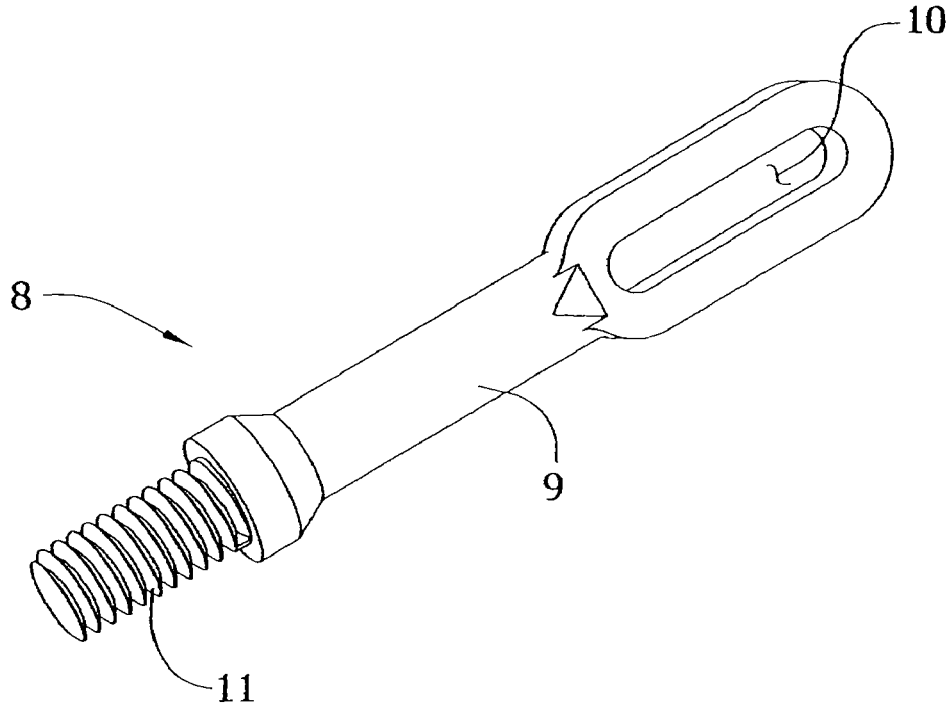
FIG. 2 is a perspective view of a prior art patch holding device in the form of a patch loop.

A second type of cleaning patch holder device, commonly known as a patch loop 8, is shown in FIG. 2. The patch loop 8 has a cylindrical shank 9 with an elliptically shaped opening 10 at the front end of the shank. Threads 11 formed at the rear end of the shank 9 allow for releasable attachment to the cleaning rod C. Both types of patch holding devices (e.g., jags 1 and patch loops 8) may be machined or cold-formed from a single piece of brass.

Figure 3:
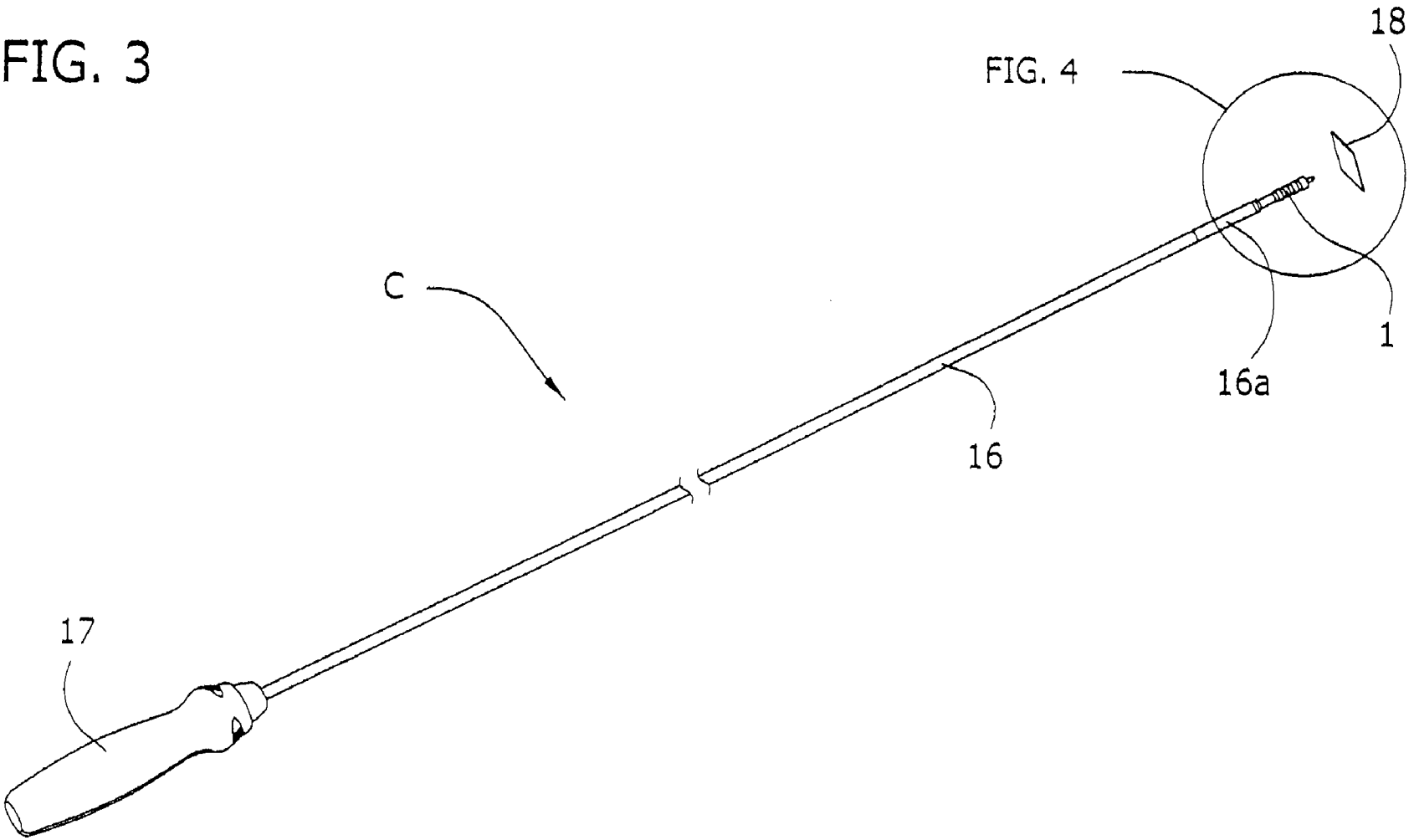
FIG. 3 is a perspective view of a prior art cleaning rod with the jag mounted on the end and a cleaning patch removed from the jag.
Figure 4:
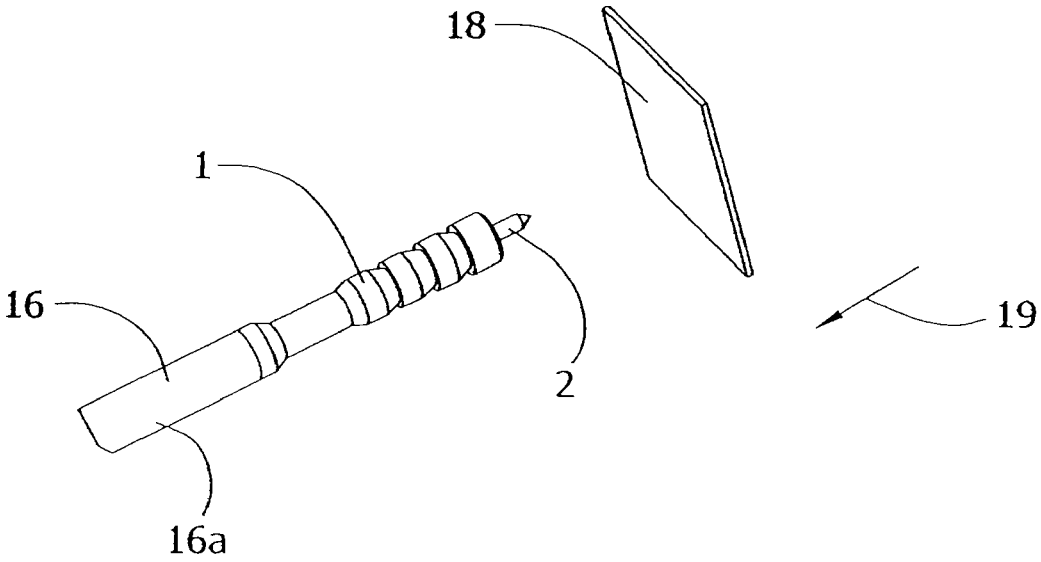
FIG. 4 is an enlarged portion of FIG. 3.
Figure 5:
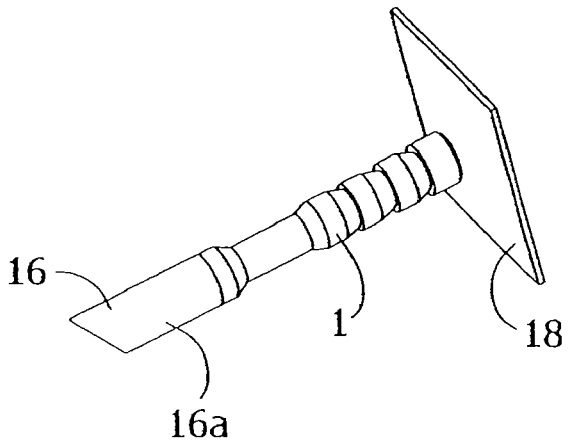
FIG. 5 is a similar view to FIG. 4 but showing the cleaning patch assembled to the jag.

FIGS. 3-5 illustrate the attachment of the cleaning patch 18 to the jag 1. The cleaning rod C includes a cylindrical shaft 16 of sufficient length to completely pass through the firearm bore and a handle 17 for manually grasping the cleaning rod. The shaft 16 has a hollow end 16*a* with internal threads (not shown) that mate with the threads 4 of the jag 1. The cleaning patch 18, typically cut from 0.03 inch thick cotton flannel cleaning cloth, is placed on the sharp point 2 of the jag 1 in the direction shown by arrow 19. The sharp point 2 pierces the cleaning patch 18 and releasably attaches the patch to the jag 1 during the cleaning process.

Figure 6:
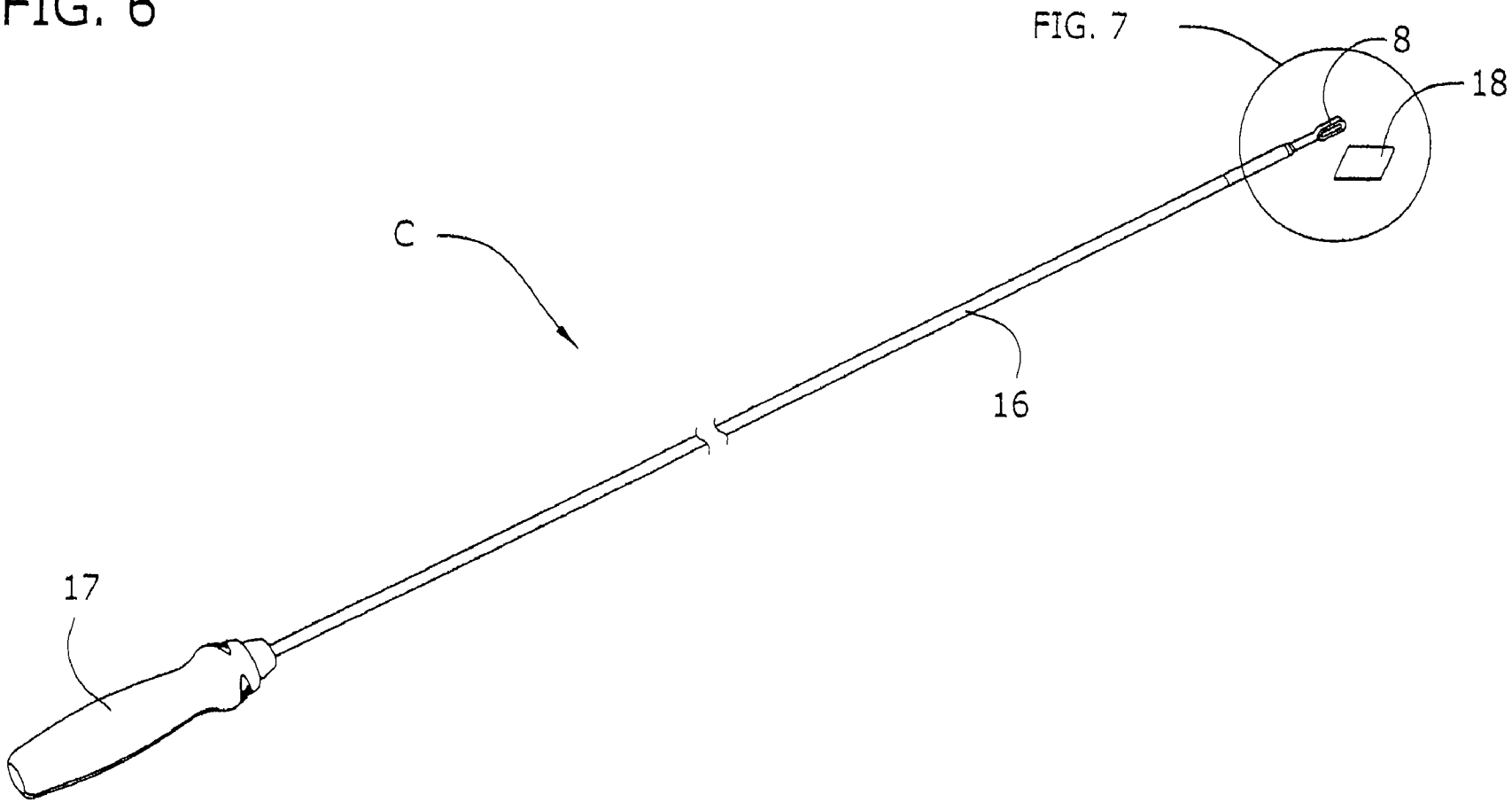
FIG. 6 is a perspective view of the cleaning rod with the patch loop assembled and the cleaning patch removed.
Figure 7:
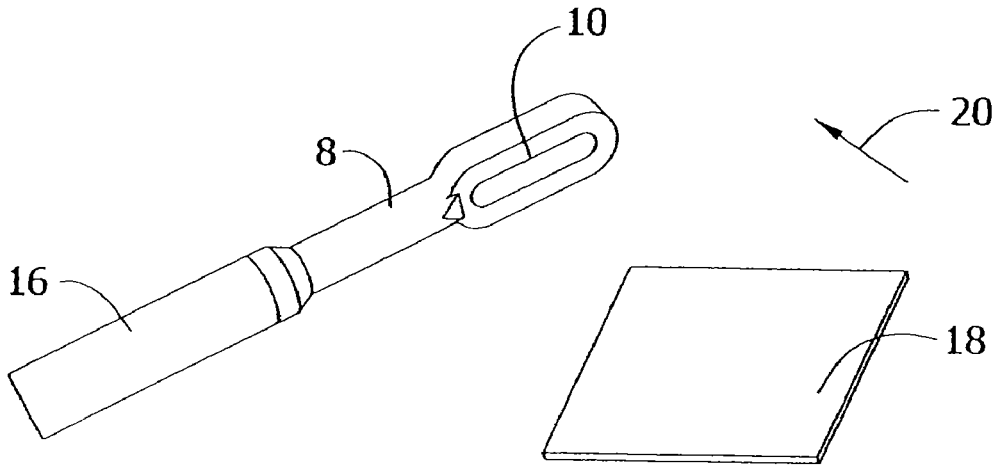
FIG. 7 is an enlarged portion of FIG. 6.
Figure 8:
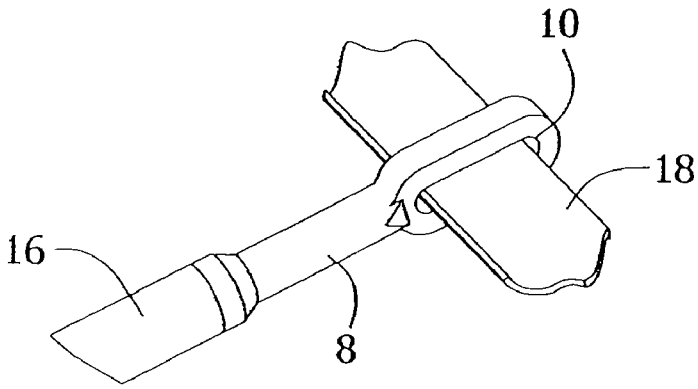
FIG. 8 is a similar view to FIG. 7 but showing the cleaning patch assembled to the patch loop.

FIGS. 6-8 illustrate the attachment of the cleaning patch 18 to the patch loop 8. The patch loop 8 is threadably engaged with the hollow end 16*a* of the cylindrical shaft 16 of the cleaning rod C. As with the embodiment of FIG. 3, the shaft 16 is of sufficient length to completely pass through the firearm bore. The cleaning patch 18 is inserted through the elliptical opening 10 in the direction shown by arrow 20 by pulling a corner of the patch through the opening such that the patch bunches together and is held in the opening. FIG. 8 shows the patch 18 pulled approximately halfway through the elliptical opening 10. The fit of the cleaning patch in the elliptical opening 10 releasably attaches the patch 18 to the cleaning patch loop 8 during the cleaning process.

Figure 9:
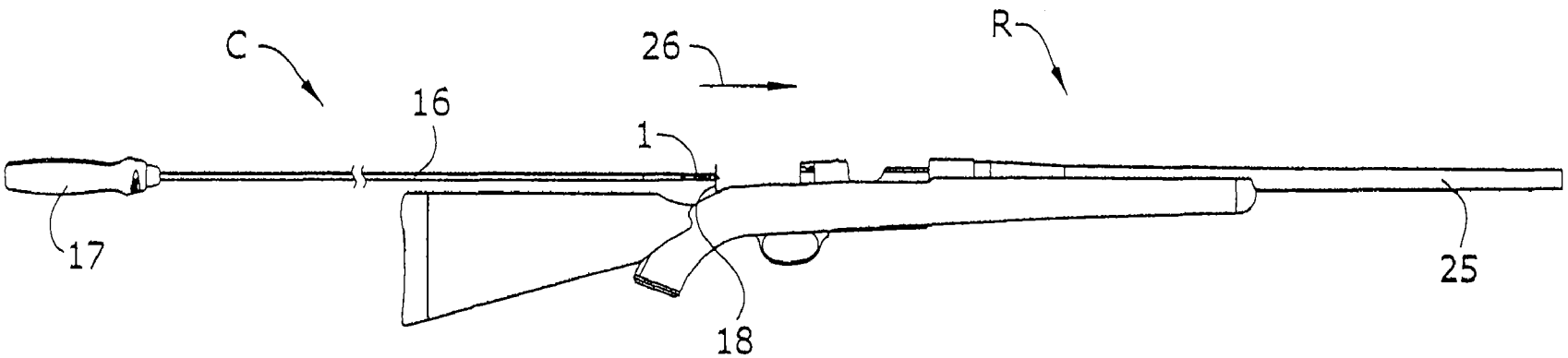
FIG. 9 is a side elevation view of a rifle with the patch holding device of FIG. 3 positioned prior to cleaning a barrel of a rifle.
Figure 10:
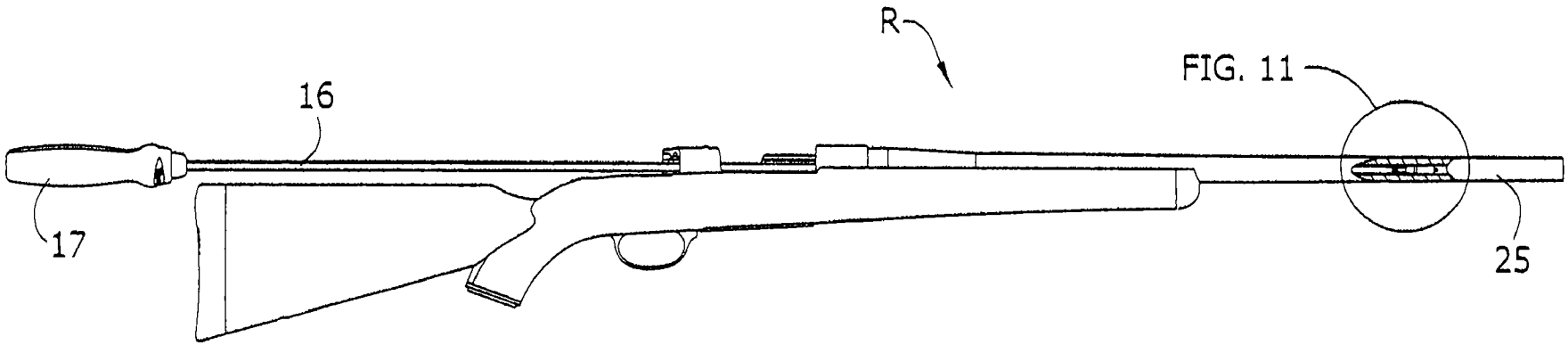
FIG. 10 is a similar view to FIG. 9 but showing the patch holding device inserted into the rifle barrel and the barrel in partial section to show the patch holding device cleaning the barrel.
Figure 11:
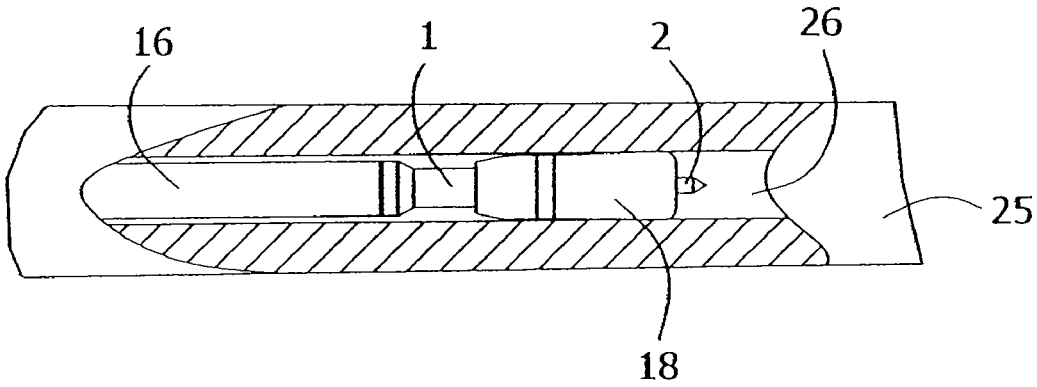
FIG. 11 is an enlarged portion of FIG. 10.

As shown in FIGS. 9 and 10, the cleaning rod C is positioned coaxial with the barrel 25 of the rifle R prior to cleaning the bore. The cleaning rod C with the jag 1 and cleaning patch 18 mounted thereon are pushed longitudinally into the barrel 25 in the direction shown by arrow 26. As shown in FIG. 11, as the jag 1 and cleaning patch 18 enter the barrel 25, the patch folds back and covers a portion of the cylindrical body B of the jag 1. The patch 18 fits in the space between the external surface of the jag 1 and the internal surface of the barrel 25. A similar scenario is observed if the patch holding device is a patch loop 8 rather than the jag 1.

Figure 12:
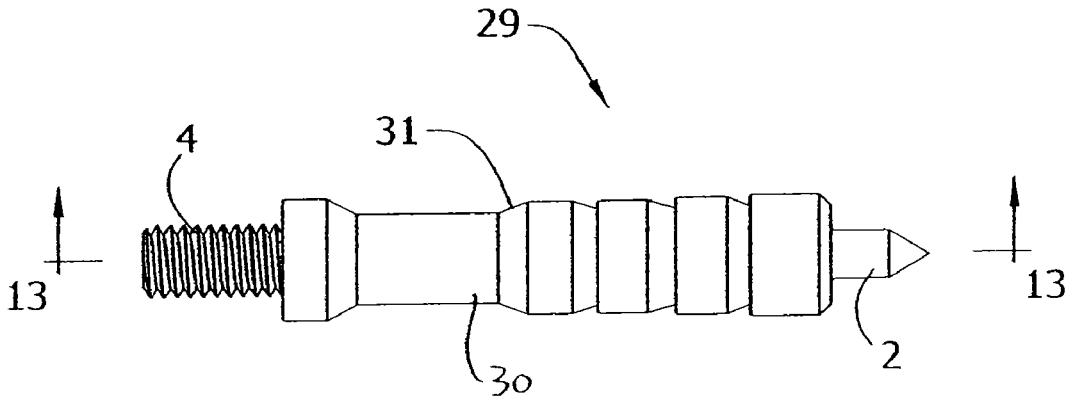
FIG. 12 is a side elevation view of one embodiment of a patch holding device of the present invention.
Figure 13:
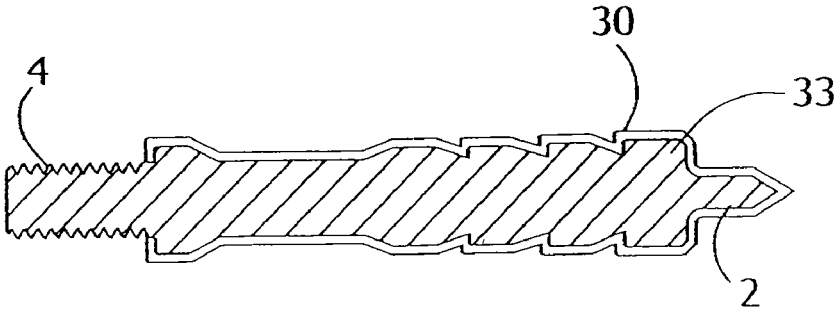
FIG. 13 is a section view taken along the plane 13-13 of FIG. 12.

FIGS. 12 and 13 illustrate a first embodiment of the cleaning patch holding device of the present invention, generally designated 29. The cleaning patch holding device 29 is in the form of a jag 31 substantially similar to the jag 1 described above. The jag 31 has a body 33 with a brass core material and a substantially similar shape as the body B of jag 1. The jag 31 has a non-reactive coating 30 that covers the core material of the body 33. The coating may be any inert material such as a synthetic coating or non-reactive metallic plating or any other material that does not typically react with firearm cleaning solvents. For example, the coating 30 may be a plastic or synthetic coating, a chemical, electrolytic, or electroless plated coating, a paint or paint like material, or any other material that is non-reactive with firearm cleaning solvent. In one particular embodiment, the coating 30 is electroless nickel plating having a thickness ranging from approximately 0.0002 inch (0.0051 mm) to approximately 0.0003 inch (0.0076 mm). It has been found that electroless nickel provides a durable, solvent resistant, and economical coating that provides an attractive appearance. It is understood that the coating 30 may be other materials with other thicknesses (e.g., nylon having a thickness ranging from approximately 0.002 inch (0.051 mm) to approximately 0.004 inch (0.10 mm) or an epoxy paint having a thickness ranging from approximately 0.0002 inch (0.0051 mm) to approximately 0.0005 inch (0.013 mm)). The above noted materials and thicknesses are exemplary and are not intended to limit the scope of the invention.

As shown in FIG. 13 the coating 30 covers the entire portion of the body 33 that would be exposed to the cleaning solvent during the cleaning process. Accordingly, the threads 4 of the jag 31 in the illustrated embodiment are uncoated since the threads would be received in the hollow end 16A of the cleaning rod shaft 16. It is understood that the threads 4 may be coated with the coating 30 without departing from the scope of this invention.

Figure 14:
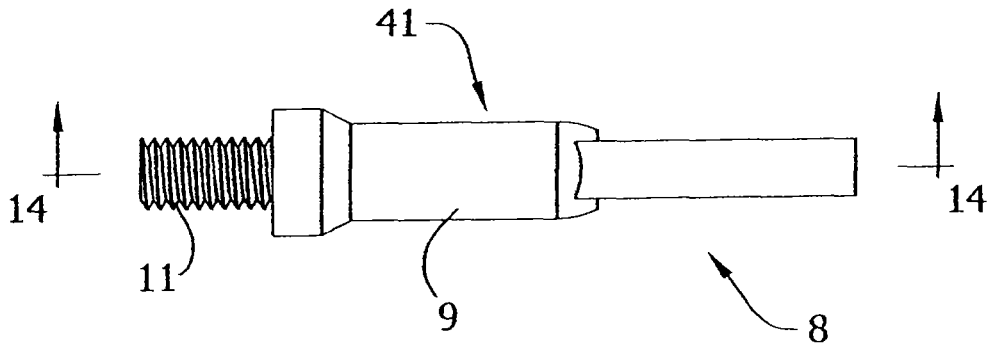
FIG. 14 is a side elevation view of a second embodiment of a patch holding device of the present invention.
Figure 15:
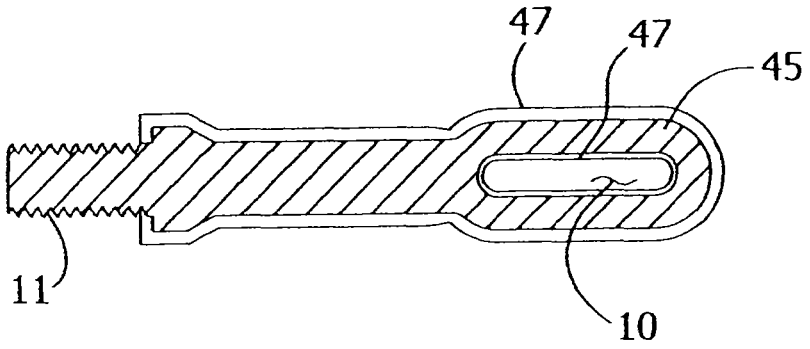
FIG. 15 is a section view taken along the plane 15-15 of FIG. 14.

FIGS. 14 and 15 show a second embodiment of a patch holding device of the present invention generally designated 41. The patch holding device is in the form of a patch loop 43 substantially similar to the patch loop 8 described above. The patch loop 43 of this invention comprises a body 45 having a brass core material and an inert coating 47 covering the core material, including the interior surface of the slot 10, to prevent the reaction of the body with cleaning solvents during the cleaning process. The coating 47 may be any of the same materials as set forth above for the previous embodiment. Further the coating may be deposited by any of the aforementioned process and have a similar range of thickness. As with the previous embodiment, the threads 11 of the patch loop 43 are shown as being uncoated but it is understood that the threads may be coated without departing from the scope of this invention.

The present invention serves to eliminate the problem of firearm cleaning solvents reacting with the brass material of jags 1 and patch loops 8 and leaving residue similar in color to fouling residue on the cleaning patch 18. Typically, firearm cleaning solvents comprise ammonia and petroleum distillates (oil) as their main components. The patch holding device 29, 41 of the present invention has a protective coating 30, 47 covering the portions of the holding device that are exposed to the cleaning solvents so that the fouling in the firearm barrel 25 is the sole source of residue on the cleaning patch 18 during the cleaning process. Because the fouling in the barrel 25 is the only source of residue exposed to the cleaning patches 18 used in the holding device 29, 41 of the present invention, it is readily apparent to the user of the holding device that the cleaning process is complete when a cleaning patch inserted into the barrel no longer accumulates fouling residue.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A firearm cleaning apparatus for cleaning the bore of a firearm barrel with firearm cleaning solvent, the cleaning apparatus comprising a cleaning patch holding device for removable attachment to a cleaning rod, the cleaning patch holding device comprising a body for holding a cleaning cloth containing firearm cleaning solvent, the body having a core material and a protective coating covering the core material to prevent the core material from contacting the firearm cleaning solvent, wherein said protective coating comprises electroless nickel plating, wherein said cleaning patch holding device is a jag.

2. The firearm cleaning apparatus set forth in claim 1 wherein said core material comprises brass.

3. A firearm cleaning apparatus for cleaning the bore of a firearm barrel with firearm cleaning solvent, the cleaning apparatus comprising a cleaning patch holding device for removable attachment to a cleaning rod, the cleaning patch holding device comprising a body for holding a cleaning cloth containing firearm cleaning solvent, the body having a core material and a protective coating covering the core material to prevent the core material from contacting the firearm cleaning solvent, wherein said protective coating comprises electroless nickel plating, wherein said cleaning patch holding device is a patch loop.

4. A firearm cleaning apparatus for cleaning the bore of a firearm barrel with firearm cleaning solvent, the cleaning apparatus comprising a cleaning patch holding device for removable attachment to a cleaning rod, the cleaning patch holding device comprising a body for holding a cleaning cloth containing firearm cleaning solvent, the body having a core material and a protective coating covering the core material to prevent the core material from contacting the firearm cleaning solvent, wherein said core material comprises brass and wherein said protective coating comprises electroless nickel plating, wherein said cleaning patch holding device is a jag.

5. A firearm cleaning apparatus for cleaning the bore of a firearm barrel with firearm cleaning solvent, the cleaning apparatus comprising a cleaning patch holding device for removable attachment to a cleaning rod, the cleaning patch holding device comprising a body for holding a cleaning cloth containing firearm cleaning solvent, the body having a core material and a protective coating covering the core material to prevent the core material from contacting the firearm cleaning solvent, wherein said core material comprises brass and wherein said protective coating comprises electroless nickel plating, wherein said cleaning patch holding device is a patch loop.

* * * * *